United States Patent [19]

Mathias

[11] Patent Number: 4,817,579

[45] Date of Patent: Apr. 4, 1989

[54] CAMOUFLAGE SHIELD FOR ARCHERS

[76] Inventor: Ralph R. Mathias, 1200 Chavel Dr., East Liverpool, Ohio 43920

[21] Appl. No.: 149,481

[22] Filed: Jan. 28, 1988

[51] Int. Cl.[4] ..... F41B 5/00; A01M 31/02

[52] U.S. Cl. ..... 124/23 R; 124/86; 43/1; 135/901

[58] Field of Search ..... 124/86, 88, 87, 80, 124/DIG. 1, 23 R, 24 R, 23 A, 24 A, 89, 1; 403/87, 93, 96; 43/1; 135/901, 109, 112

[56] References Cited

U.S. PATENT DOCUMENTS

| | | | |
|---|---|---|---|
| 276,791 | 5/1883 | Engle, Jr. | 403/87 X |
| 1,290,606 | 1/1919 | Lovas | 124/23 R |
| 2,156,367 | 5/1939 | Zadek | 403/93 |
| 2,464,068 | 3/1949 | Bear | 124/24 R |
| 2,784,779 | 3/1957 | Knipfer et al. | 135/109 X |
| 3,179,102 | 4/1965 | Peckham | 124/23 R |
| 3,342,172 | 9/1967 | Sanders | 124/23 R |
| 3,365,209 | 1/1968 | Fischer | 403/96 X |
| 3,815,907 | 6/1974 | Cook | 124/1 X |
| 3,913,598 | 10/1975 | Glutting, Jr. et al. | 43/1 X |
| 4,082,102 | 4/1978 | Heuer | 403/93 X |
| 4,186,507 | 2/1980 | Stinnett | 43/1 |
| 4,716,919 | 1/1988 | Griffin | 135/901 X |

*Primary Examiner*—Dave W. Arola
*Assistant Examiner*—Peter M. Cuomo
*Attorney, Agent, or Firm*—Harpman & Harpman

[57] ABSTRACT

A camouflage device for disguising and concealing an archer and a hunting bow is disclosed which comprises a lightweight frame supporting camouflage netting, the frame being adjustably and removably attached to a hunting bow and preferably having a section thereof of camouflage netting adapted to permit the archer to see therethrough together with an opening through which an arrow propelled by the hunting bow may pass.

4 Claims, 1 Drawing Sheet

CAMOUFLAGE SHIELD FOR ARCHERS

BACKGROUND OF THE INVENTION

1. Technical Field

This invention relates to camouflage and devices for disguising, hiding, or concealing an archer from game being hunted.

2. Description of the Prior Art

Only two prior art patents are known and comprise U.S. Pat. Nos. 1,290,606 and 3,179,102. The device of U.S. Pat. No. 1,290,606 entitled "A Gunner's Shield" combines a gun mount and a generally V-shaped shield having an opening in the apex thereof through which the barrel of the gun is positioned. The V-shaped shield is positioned on the gun mount in spaced relation to the gun. U.S. Pat. No. 3,179,102 shows an attachment blind for archers consisting of a panel of screen-like material secured to a frame which is provided with vertically spaced C-clamps by which it is affixed to an acher's bow in fixed relation thereto. A flap of the screen material registers with an opening therein through which an arrow may be projected.

The present invention provides a camouflage device of relatively small size and weight which is adjustably and removably attached to a compound bow formed of a pair of laminated limbs secured in oppositely disposed relation to a magnesium riser, the riser having a hand grip area and a specific area to which a sight, quiver, and the camouflage device of the invention can be readily attached.

SUMMARY OF THE INVENTION

A camouflage device for archers comprises a lightweight, preferably metal frame arranged to be adjustably and removably attached to a hunting bow, the frame carries a section of camouflage fabric and a mounting arm assembly providing adjustable, detachable means of positioning the frame and camouflage fabric in spaced relation to a hunting bow and an archer holding the same.

DESCRIPTION OF THE PREFERRED EMBODIMENT

Figure 1:
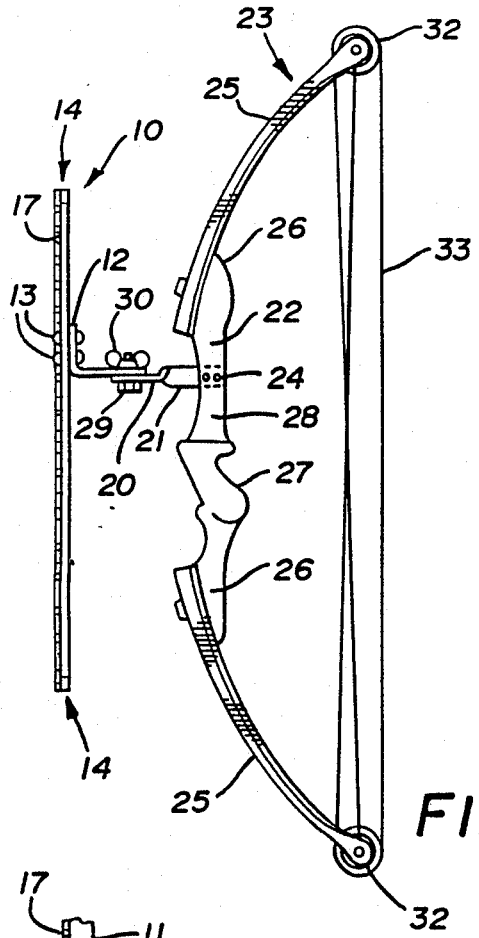
FIG. 1 is a side elevation of a hunting bow illustrating the camouflage device attached thereto in right angular relation thereto.
Figure 2:
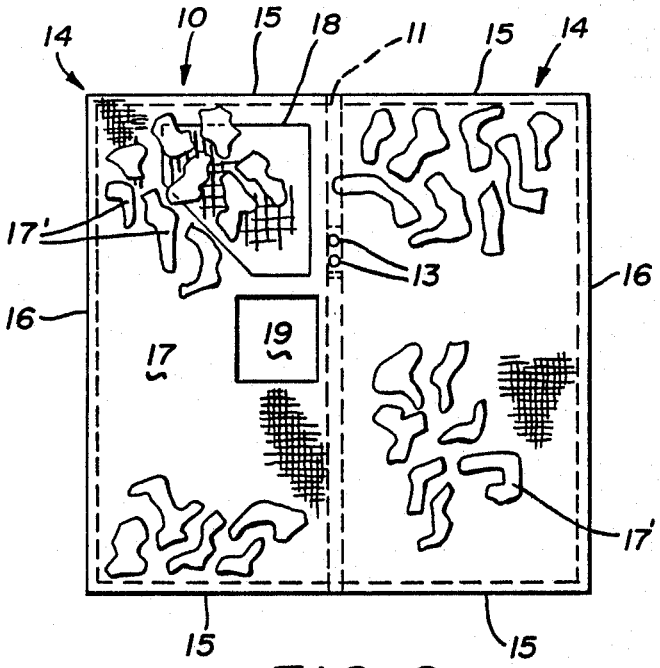
FIG. 2 is a front plan view of the camouflage device, broken lines indicating a vertical center frame member to which oppositely disposed frames are attached.
Figure 3:
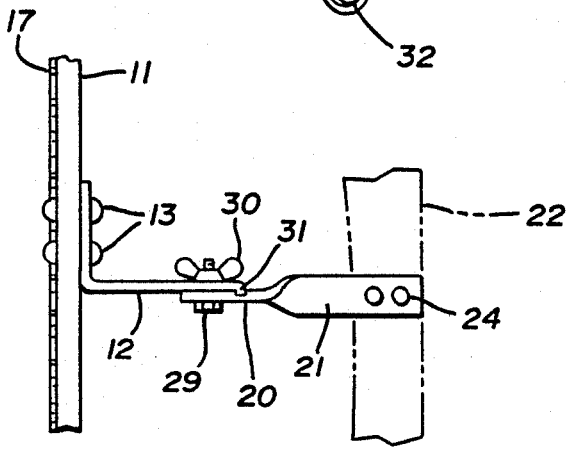
FIG. 3 is an enlarged detail of a portion of a center frame of the camouflage device and a two-part support arm extending therefrom, broken lines indicating a portion of the riser of an archer's compound bow.

In the form of the invention disclosed herein, the camouflage device for archers may be seen in FIGS. 1 and 2 where it is generally indicated by the numeral 10 and specifically disclosed as comprising a lightweight vertical frame member 11 to which an L-shaped first arm 12 is attached by fasteners 13. The vertical frame member 11 positions and supports a pair of oppositely disposed C-shaped frame members 14, each of which includes a pair of vertically spaced horizontal frame members 15 and a vertical frame member 16. The oppositely disposed ends of the horizontally disposed frame members 15 are attached to the upper and lower ends respectively of the vertical frame member 11 so that in one form of the invention the C-shaped frames 14 may be moved toward one another in effect folding the camouflage device on a vertical center line defined by the vertical frame member 11. The C-shaped frame members 14 are covered with camouflage fabric netting 17 which as best illustrated in FIG. 2 of the drawings carries a camouflage print design 17' which may vary in color to match the yearly season, for example predominately green for the Spring season, a green and brown mixture for the Summer season, and blaze orange and brown for the Fall season, or such other colors as various rules and regulations may specify.

By referring to FIG. 2 of the drawings, it will be seen that a portion of the camouflage fabric netting material 17 indicated by the outline 18 is formed with camouflage netting having relatively larger openings between the horizontal and vertical threads thereof so that it forms an area through which visibility is increased while retaining its camouflage characteristics. The camouflage device is also provided with an opening 19 preferably located below the area 18 of increased visibility above described so that an arrow may be projected therethrough as driven by the compound bow to which the camouflage device is adjustably and removably attached. The camouflage fabric may be scrim.

Figure 4:
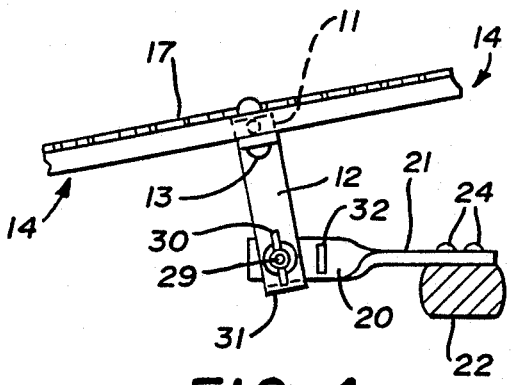
FIG. 4 is an enlarged detail in top plan illustrating the device of FIG. 3 in an adjacent positioned with respect to the riser of an archer's bow.

Still referring to FIG. 1 of the drawings, it will be seen that the L-shaped first arm 12 extends rearwardly of the camouflage device 10 on a horizontal plane and overlies a horizontal end portion 20 of a second arm which includes a vertically disposed portion 21 for attachment to a riser 22 of a hunting bow generally indicated at 23 in FIG. 1 of the drawings. The hunting bow illustrated is a compound bow, the limbs 25 of which are preferably of laminated construction as known in the art and secured at their inner ends to upper and lower enlarged portions 28 of the riser 22 which is provided with a molded hand grip 27 and an elongated center section 28 to which the vertical portion 21 of the second arm is attached by the fasteners 24. The horizontal portion of the first arm 12 and the horizontal portion 20 of the second arm are apertured and a bolt 29 and butterfly nut 30 thereon adjustably secure the same to one another. The outermost end of the L-shaped arm 12 is preferably provided with a projection 31 positioned for registry with a depression 32 in the horizontal end 20 of the second arm or alternately for engagement against a side of the same as best illustrated in FIG. 4 of the drawings and it will thus be seen that the camouflage device is both readily attachable and detachable with respect to the riser of a compound bow and while attached thereto can be moved to a full shield position as shown in FIGS. 1 and 2 of the drawings and an out of the way to one side position as shown in FIG. 4 of the drawings all with respect to the archer and the path of an arrow projected by the bow.

By referring again to FIG. 1 of the drawings, it will be seen that the outermost ends of the laminated limbs 25 of the bow are provided with transition wheels 32 over which a bow string 32 of the compound bow is trained as will be understood by those skilled in the art.

It will thus be seen that a camouflage device for an archer has been disclosed which is lightweight, portable, and easily attached to a bow such as disclosed herein and that it is equally easily adjusted from a first position where it forms a shield for the archer and the bow to a second position at either side of the bow where it is spaced with and generally parallel with the flight path of an arrow projected by the bow as will be understood by those skilled in the art.

Having thus described my invention, what I claim is:

1. An improvement in a camouflage device attachable to an archer's bow having a riser and outwardly extending limbs attached thereto, the improvement comprising a foldable upright frame with a centrally positioned upright frame member having upper and lower ends and a section of camouflage fabric material having an opening therein secured to said foldable upright frame, a two part support arm, a first part of which is attached to said centrally positioned upright frame member and a second part of which is attached to said riser, means pivotally and adjustably securing said first and second parts of said two part support arm to one another whereby said camouflage device may be moved from a first position at a right angle to said riser and limbs of said bow to a second position at either side of said riser and limbs of said bow, said foldable upright frame comprising a pair of oppositely disposed generally C-shaped upright frames having spaced ends, said spaced ends pivotally attached to said upper and lower ends of said centrally positioned upright frame member whereby said camouflage device may be arranged in a narrow vertical shape, a V-shape and a flat shape.

2. The improvement in a camouflage device set forth in claim 1 and wherein a portion of said camouflage fabric material comprises scrim that appears opaque from one side and transparent from the opposite side.

3. The improvement is a camouflage device set forth in claim 1 and wherein said generally C-shaped frames are movably attached to the opposite ends of said centrally positioned upright frame member whereby the relative positions of said frames and the camouflage fabric material thereon may be changed from planar to angular.

4. The improvement in a camouflage device set forth in claim 1 and wherein said openings formed in said camouflaged material is positioned so that an arrow projected by said bow may pass therethrough.

* * * * *